US006098345A

United States Patent [19]

Demartini et al.

[11] Patent Number: 6,098,345

[45] Date of Patent: Aug. 8, 2000

[54] REELABLE RAIN GUTTER COVER

[76] Inventors: Robert J. Demartini, 208 Pineholt La., Flat Rock, N.C. 28731; David R. Demartini, 357 Hartford Rd., Danville, Calif. 94526

[21] Appl. No.: 09/052,589

[22] Filed: Mar. 31, 1998

[51] Int. Cl.[7] ..... E04D 13/064

[52] U.S. Cl. ..... 52/12; 52/11; 210/474; 248/48.1

[58] Field of Search ..... 52/11–15; 248/48.1, 248/48.2; 405/118, 119; 210/474, 477

[56] References Cited

U.S. PATENT DOCUMENTS

| | | | |
|---|---|---|---|
| 3,295,264 | 1/1967 | Olson | 52/12 |
| 3,367,070 | 2/1968 | Mitchell | 52/12 |
| 4,241,548 | 12/1980 | Rowe . | |
| 4,311,292 | 1/1982 | Deason . | |
| 4,404,775 | 9/1983 | Demartini . | |
| 4,435,925 | 3/1984 | Jefferys | 52/12 |
| 4,445,301 | 5/1984 | Tanski . | |
| 4,446,658 | 5/1984 | Gouin . | |
| 4,669,232 | 6/1987 | Wyatt . | |
| 4,696,131 | 9/1987 | Schreffler . | |
| 4,757,649 | 7/1988 | Vahldieck . | |
| 4,796,390 | 1/1989 | Demartini . | |
| 4,912,888 | 4/1990 | Martin . | |
| 5,016,404 | 5/1991 | Briggs | 52/12 |
| 5,154,025 | 10/1992 | Brown . | |
| 5,181,350 | 1/1993 | Meckstroth . | |
| 5,216,852 | 6/1993 | Bemis et al. . | |
| 5,375,379 | 12/1994 | Meckstroth . | |
| 5,406,755 | 4/1995 | Serano . | |
| 5,457,916 | 10/1995 | Tenute . | |
| 5,459,965 | 10/1995 | Meckstroth . | |
| 5,495,694 | 3/1996 | Kuhns . | |
| 5,557,891 | 9/1996 | Albracht . | |
| 5,638,643 | 6/1997 | Demartini et al. . | |
| 5,640,809 | 6/1997 | Iannelli . | |
| 5,819,476 | 10/1998 | Annestedt, Sr. | 52/11 |
| 5,848,857 | 12/1998 | Killworth et al. | 52/11 X |

OTHER PUBLICATIONS

Pamphlet entitled "Terrain Torrent—The Deeper Flow System," by Terrain Professional Plumbing Systems, Aylesford, Kent, Great Britain, dated 1994.

*Primary Examiner*—Carl D. Friedman
*Assistant Examiner*—Winnie Yip
*Attorney, Agent, or Firm*—Nelson Mullins Riley & Scarborough

[57] ABSTRACT

An elongate gutter cover adapted to be positioned over the open trough of a conventional rain gutter. The gutter cover is configured to deflect leaves and other debris away from the gutter. The rain water, however, follows the contour of the gutter cover into the gutter itself. The gutter cover is made from materials that are substantially entirely deformation reversible between two extreme configurations. Starting with the configuration desired in service, the gutter cover is flattened to permit coiling in a longitudinal dimension. Upon being uncoiled, the gutter cover resumes the operative configuration in which it is used. In some embodiments, the gutter cover may comprise several plastic materials that have been coformed to provide the desired characteristics. The invention provides a novel method of installing a gutter cover system with less labor and skill than has typically been required in the prior art.

27 Claims, 8 Drawing Sheets

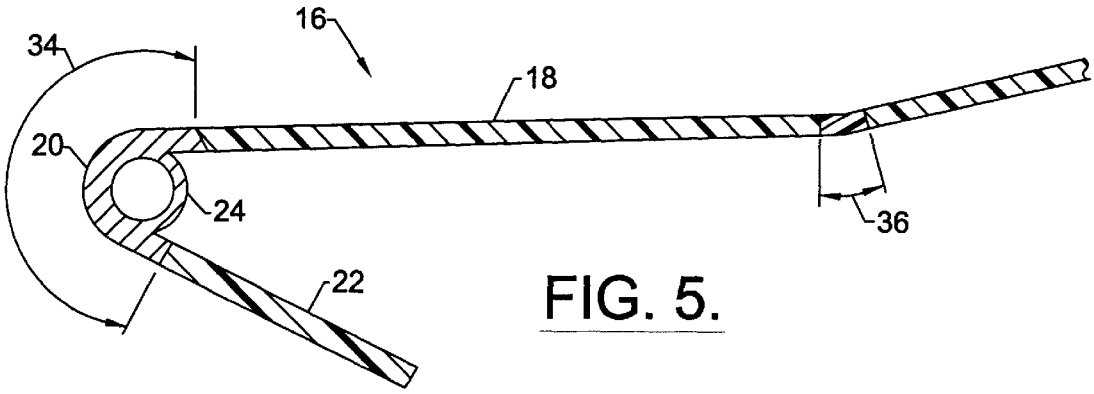
FIG. 5.
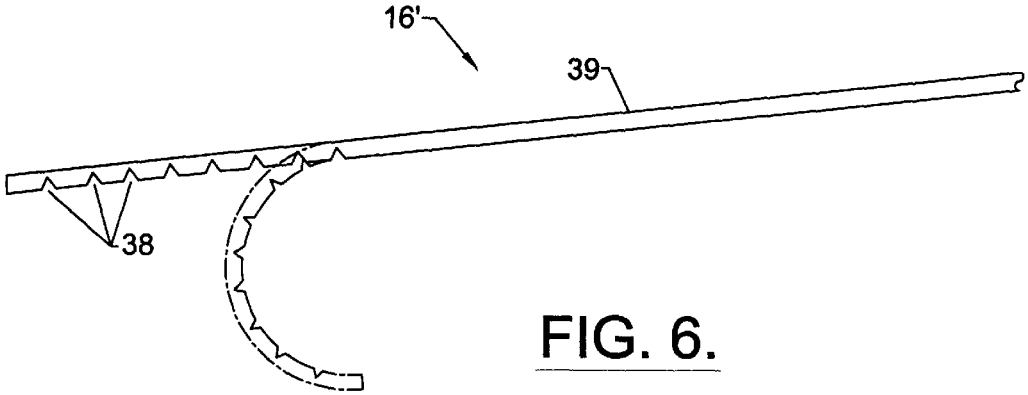
FIG. 6.
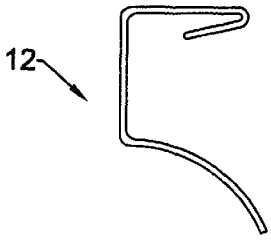

REELABLE RAIN GUTTER COVER

BACKGROUND OF THE INVENTION

The present invention relates generally to the art of gutter covers utilized to deflect leaves or other debris away from a rain gutter.

As is well known, rain gutters are often installed along the roof edge of a structure to collect and divert rain water flowing off the roof. A persistent problem with such gutters is that they also collect leaves and other debris, such as sticks, roof granules, pine needles and the like. The gutters must be cleared periodically to prevent the debris from interfering with normal gutter operation.

The prior art has provided several methods to reduce the need to manually clear rain gutters. For example, a gutter cover may be placed over the open trough of the rain gutter. Due to the cover's configuration, debris will be deflected off of the roof onto the ground. The rain water, on the other hand, will be directed into the gutter due to surface tension properties. Various aspects of such gutter covers are discussed in U.S. Pat. No. 4,404,775, incorporated herein by reference.

In the past, gutter covers have typically been produced of rigid material, such as aluminum. To facilitate shipment, the gutter cover material is provided in predetermined lengths that are relatively short. For example, five foot lengths of gutter cover have been utilized in a known implementation.

While yielding an effective gutter cover product, the use of rigid lengths gives rise to high labor cost and difficulty during installation. Generally, multiple pieces will be required to cover the gutter along one side of a structure. In addition to the time and labor entailed in this process, the individuals performing the installation must have a requisite degree of skill.

SUMMARY OF THE INVENTION

The present invention recognizes and addresses the foregoing disadvantages, and others of prior art constructions and methods. Accordingly, it is an object of the present invention to provide an improved gutter cover.

It is a particular object of the present invention to provide a gutter cover provided in indeterminate continuous length.

It is a further object of the present invention to provide a gutter cover provided in indeterminate continuous length that may be easily cut to a desired length at the time of installation.

It is a further object of the present invention to provide gutter cover stock that may be conveniently shipped and handled prior to installation.

It is a more particular object of the present invention to provide gutter cover stock having inherent memory to resume an operative configuration upon being released from a supply configuration.

It is a particular object of the present invention to provide gutter cover stock that may be supplied in roll form.

It is also an object of the present invention to provide a novel method of producing rain gutter cover.

Some of these objects are provided by a rain gutter cover comprising an elongate cover member adapted to be situated over an open trough of a rain gutter. The cover member has a first cover portion integrally extending into a second water directing portion. An outer surface of the elongate cover member is adapted to substantially cause water passing thereover to form a film. The cover member is formable into a first compact supply configuration and a second operative configuration. For example, the cover member may be coiled in the supply configuration and assume the operative configuration upon being uncoiled.

In some exemplary embodiments, the cover member is formed substantially entirely of flexible plastic material, such as a PVC material. It is contemplated that other materials also having desired "memory" characteristics, such as spring stainless steel, may also be utilized. Plastic will often be preferred, however, due to cost considerations and other factors.

In some cases, the elongate cover member may have regions formed of a plastic material having a different elasticity property than adjacent regions in order to facilitate formation of the cover member into the respective supply and operative configurations.

The cover portion and the water directing portion of the cover member may each be substantially planar. In such embodiments, the cover portion may extend integrally into the water directing portion about a rounded nose portion. In some embodiments, the rounded nose portion may be rendered flexible by a plurality of parallel score lines defined thereon. This flexibility facilitates formation of the cover member into the supply and operative configurations.

A web member may be provided to advantageously interconnect inner surfaces of the cover portion and the water directing portion. When the cover member is in the operative configuration, the web member will function to maintain a predetermined angular separation between the cover portion and the water directing portion.

The gutter cover may further comprise at least one bracket device connectable to the cover member and the rain gutter. The bracket maintains the cover member in proper physical relation to the gutter. Generally, a plurality of brackets will be spaced apart at predetermined locations along the rain gutter.

In exemplary embodiments, the respective brackets may be constructed of various suitable materials, such as configured sheet metal, molded plastic or a configured block of elastomeric material. According to a still further alternative, a mounting tube may be attached to a bottom surface of the first cover portion. In this case, the bracket may comprise a pin member for insertion into the mounting tube.

Other objects of the present invention are achieved by a rain gutter cover for use with a rain gutter which collects water flowing from a roof of a structure. The rain gutter cover comprises an elongate cover member adapted to be situated over an open trough of the rain gutter. The elongate cover member is formed substantially entirely of flexible plastic material formable into a first supply configuration for coiling in a long dimension thereof and a second operative configuration upon being uncoiled.

The elongate cover member has a first cover portion adapted to be connected to the roof of the structure. The cover portion integrally extends into a second water directing portion about a rounded nose portion. The water directing portion terminates above the open trough of the rain gutter. Bracket devices, connectable to the cover member and the rain gutter, are spaced apart at predetermined locations to maintain the cover member in position thereover.

Still further objects of the present invention are achieved by a rain gutter cover for use with a rain gutter which collects water flowing from a roof of a structure. The rain gutter cover comprises an elongate cover member adapted to be situated over an open trough of the rain gutter. The cover member has a substantially planar first cover portion adapted to be connected to the roof of the structure. The cover portion integrally extends about a rounded nose portion into a substantially planar second water directing portion. The water directing portion terminates above the open trough of the rain gutter. The cover member further comprises a web member interconnecting inner surfaces of the cover portion and the water directing portion to maintain a predetermined angular separation therebetween.

Additional objects of the present invention are achieved by a method of producing a rain gutter cover for use with a rain gutter which collects water flowing from a roof of a structure. One step of the method involves providing a coil of an elongate cover member in a first supply configuration. A predetermined length of the elongate cover member is then withdrawn from the coil. Next, the predetermined length of the elongate cover member is mounted over an open trough of the rain gutter in a second operative configuration.

Other objects, features and aspects of the present invention are achieved by various combinations and subcombinations of the disclosed elements, which are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which:

FIG. 5 is a fragmentary cross sectional view illustrating the use of two plastic materials from which the gutter cover is formed;

FIG. 6 illustrates an alternative embodiment in which a nose portion of the gutter cover is rendered flexible by a plurality of parallel score lines;

Figure 1:
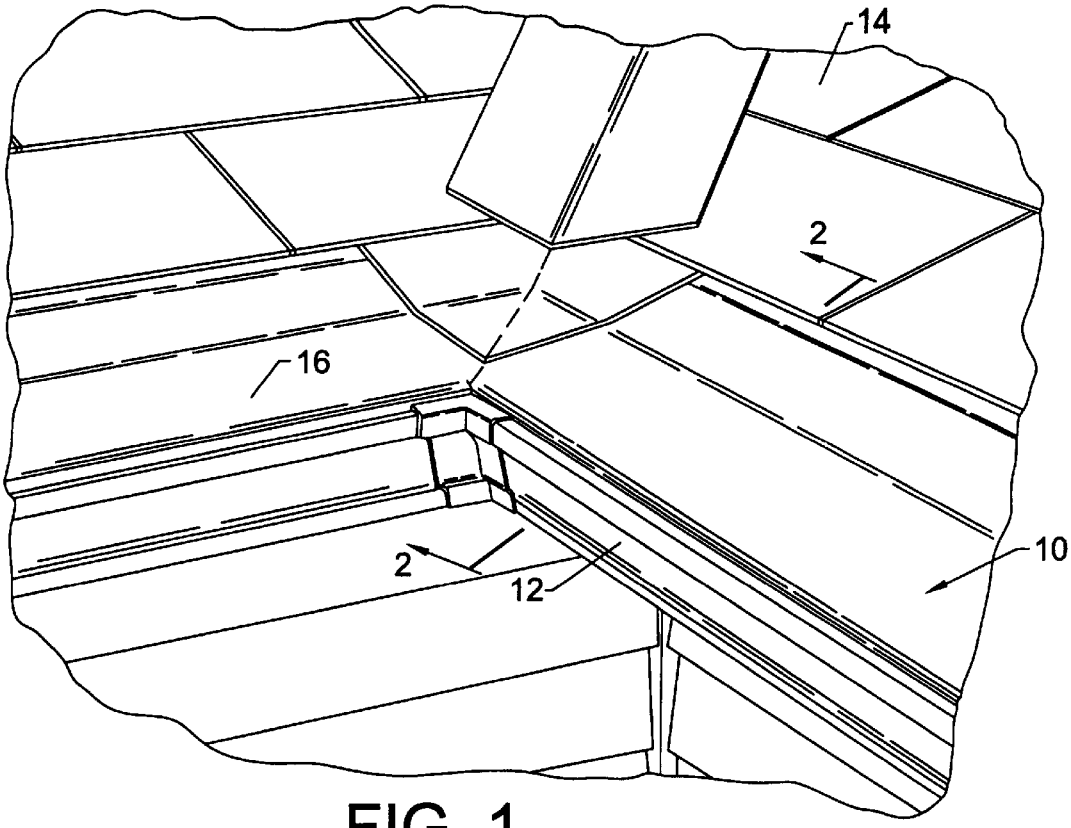
FIG. 1 is a perspective view illustrating a gutter cover of the present invention as it may appear when installed n position over a rain gutter.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

FIG. 1 illustrates a gutter cover 10 of the present invention installed in conjunction with a rain gutter 12. Rain gutter 12 is conventionally positioned to collect and divert rain water flowing off the roof 14 of a structure such as a house. Gutter cover 10 includes an elongate cover member 16 located over the open trough of gutter 12. A plurality of spaced apart brackets, such as those explained more fully below, maintain cover member 16 in position with respect to gutter 12.

Figure 2:
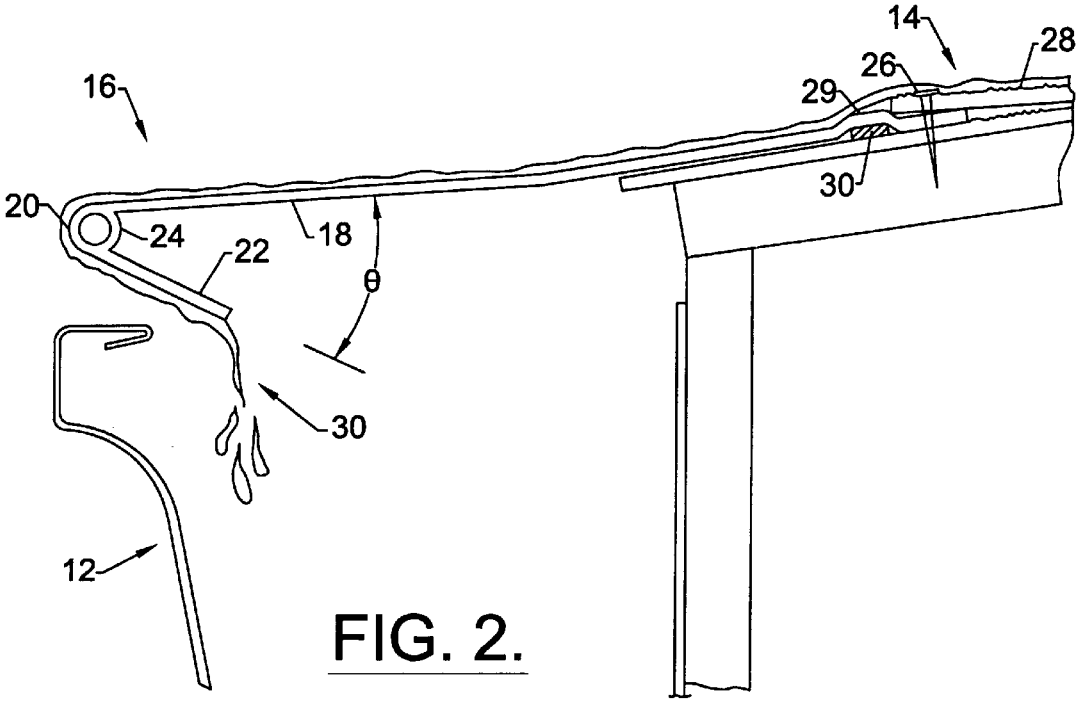
FIG. 2 is a diagrammatic elevational view illustrating placement of a gutter cover of the present invention in relation to the rain gutter.

As shown in FIG. 2, cover member 16 has a cover portion 18 integrally extending about a rounded nose portion 20 into a water directing portion 22. A web member 24 extends between the inner surfaces of cover portion 18 and water directing portion 20 to maintain a predetermined angular separation θ. In this case, web member 24 is shown located relatively close to nose portion 20. Often, however, it will be desirable to position web member 24 at other locations along the inside surface of water directing portion 22 and at various angles other than that which is shown. Preferably, the outer surface of cover member 16 has excellent water filming characteristics. Gutter cover 10 thus functions in a manner similar to the prior art, directing rain water into the gutter while deflecting away leaves and other debris.

In order to make the gutter cover less noticeable when viewed from the ground, the illustrated embodiment has a "low profile" configuration. Toward this end, both cover portion 18 and water directing portion 22 may be generally planar as shown. Nose portion 20 preferably has a relatively small diameter, such as only about 0.25" in one exemplary embodiment. In such embodiments, the angular separation θ between cover portion 18 and water directing portion 22 may be about 32°.

Cover portion 18 is attached to roof 14 by nails, such as nail 26, or other suitable means of attachment. In this case, the edge of cover portion 18 is inserted under shingles 28, which may be the first course of shingles in many cases. A longitudinal recess 29 is defined in cover portion 18 to receive an adhesive sealing strip 30 therein.

Alternatively, cover portion 18 may lay atop the first course, as appropriate to conditions in the particular installation. Due to water filming characteristics, rain water falling on and flowing over cover portion 18 will follow the contour of cover member 16. In other words, the water will flow about nose portion 20 and along water directing portion 22. As indicated at 30, the water will then flow into the open gutter at the location where water directing portion 22 terminates.

Figure 3:
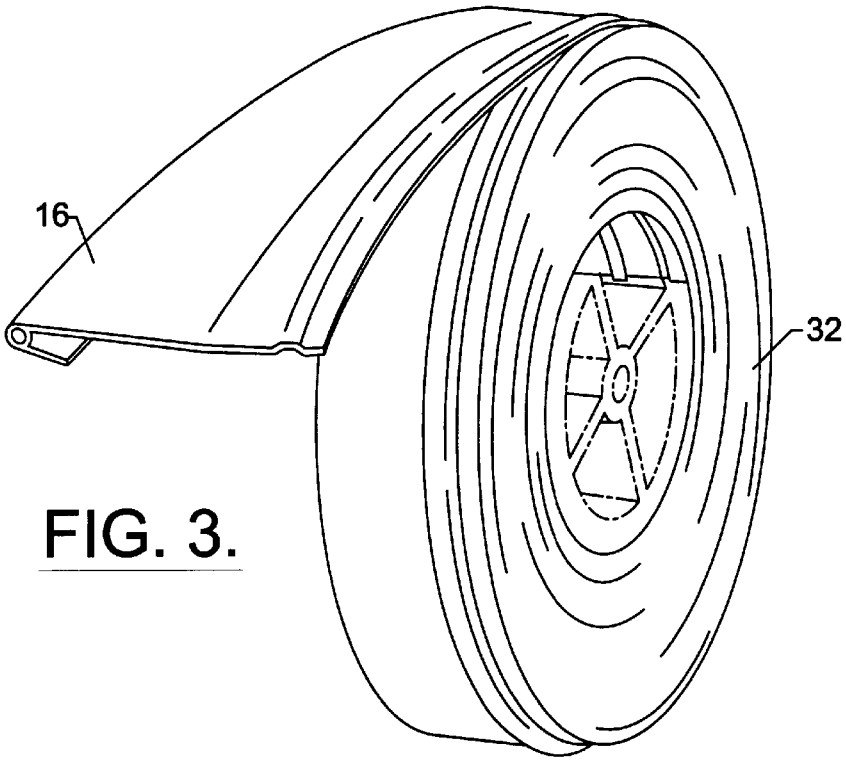
FIG. 3 is a diagrammatic perspective view of a coil of gutter cover stock according to the present invention.
Figure 4:
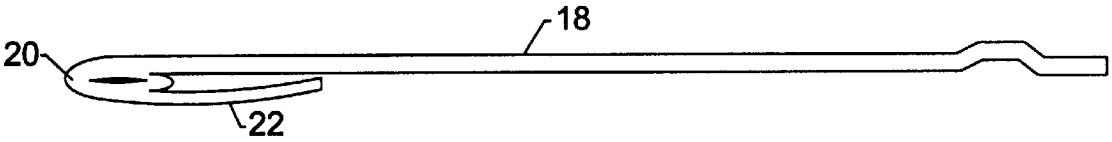
FIG. 4 shows the gutter cover of the present invention compressed into a supply configuration which permits coiling thereof.

Referring now to FIGS. 3 and 4, certain important aspects of the present invention will be described. As noted above, prior art gutter covers have typically been provided in discrete lengths of rigid material. This has often required considerable labor and skill during the installation process. They have also required considerable space to ship and store quantities of the gutter cover material. To overcome these disadvantages, cover member 16 is made from a flexible material which may be formed into a compact supply configuration. In fact, the material may be coiled in its long dimension in presently preferred embodiments to permit dispensing indeterminate continuous at the job site. While the material should be flexible for coiling, it should be rigid enough so that no substantial sagging occurs between mounting brackets when cover member 16 is installed.

FIG. 3 illustrates a coil 32 of cover member 16 that has been produced in this manner. At the time of installation, the material is simply unreeled from the coil and cut at the desired length. For example, if the length of a "run" to be installed is twenty-three feet, a corresponding length of material may be cut on site. One continuous cover can then be installed instead of four five-foot lengths and a tailored three-foot piece as may have been installed in the past.

FIG. 4 shows cover member 16 in the flattened supply configuration. As described above, this flattened configuration permits cover member 16 to be easily coiled. Because cover member 16 will be thicker on the nose portion side, it may be desirable to utilize an inexpensive, disposable cord or tape on the opposite lateral side for the purpose of achieving a stable reel. Alternatively, the same result might be achieved by providing opposed flange walls on the reel.

Preferably, cover member 16 is made from materials that are substantially entirely "deformation reversible." According to this concept, which is described in U.S. Pat. No. 5,638,643 (incorporated herein by reference), cover member 16 may be manufactured in the nonflattened configuration of FIG. 2. Cover member 16 is then flattened when reeled, and remains so during storage and shipment. Upon being unreeled, however, the nonflattened configuration will again be formed. Preferably, the material will have "memory" such that the nonflattened state returns automatically.

Referring now to FIG. 5, further details regarding the construction of cover member 16 may be explained. In this case, cover member 16 is formed to have alternate regions of greater flexibility and greater rigidity. In particular, greater flexibility is provided at locations 34 and 36. Location 34 corresponds to nose portion 20 (including web member 24), which must undergo substantial deformation during coiling. Location 36 is an inflection point provided so that various roof pitches can be easily accommodated. Greater rigidity is provided in the other regions of cover member 16.

In presently preferred embodiments, the regions of greater rigidity may be formed of PVC or another material having similar properties. The more flexible regions may be formed, for example, of a flexible rubber compound, flexible PVC or the like. Alternatively, PVC or other similar material may simply have a sufficiently thin cross section which renders it more flexible than other regions. Where cover member 16 is formed of more than one material, the constituent materials may be coextruded during the manufacturing process. Depending on the material chosen, it may be desirable to enhance hydrophilicity at the surface, thus achieving better filming of water flowing thereacross. Various techniques are believed to enhance the water filming characteristics of such a material, including abrading, chemical cleaning and coating, as with a suitable paint.

FIG. 6 illustrates an alternative cover member 16' produced in accordance with the present invention. A series of parallel score lines, such as those indicated at 38, are formed on the inner surface of cover member 16'. Alternatively, the score lines can be formed on the outer surface of cover member 16'. In this embodiment, cover member 16' is laid flat for reeling. When cover member 16' is unreeled, the nose portion 20' may be simply formed by bending as shown. Suitable brackets may be utilized to maintain the operative configuration, if the material itself does not have sufficient memory. The region indicated at 39 functions as the cover portion.

Figure 7:
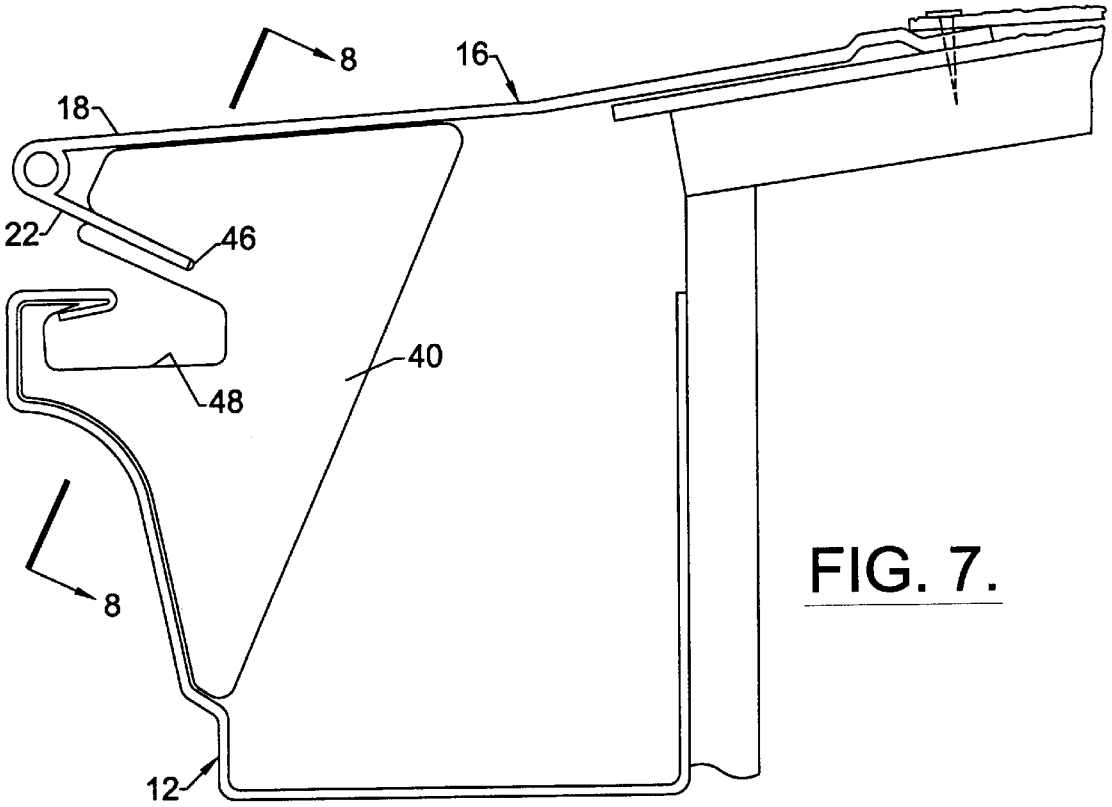
FIG. 7 is a view similar to FIG. 2 illustrating a first bracket configuration.
Figure 8:
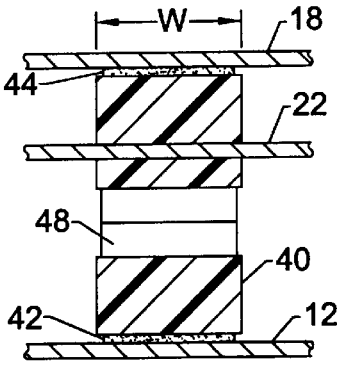
FIG. 8 is a cross sectional view taken along line 8—8 of FIG. 7.

As will now be described with reference to the remaining figures, various bracket configurations may be utilized with cover member 16. For example, FIGS. 7 through 8 illustrate a bracket 40 constructed of a configured block of elastomeric material, molded plastic or the like. The block is configured to engage the inner surface of gutter 12, while maintaining cover member 16 in the desired position. In this case, a double-sided adhesive material 42 is utilized to attach bracket 40 to gutter 12. A double-sided adhesive material 44 may likewise be used between the upper portion of bracket 40 and the inner surface of cover portion 18. It should be understood that other suitable attachment means, such as screws and the like, may also be utilized for this purpose.

As shown, bracket 40 defines a slot 46 into which the water directing portion 22 of cover member 16 is inserted. When fully inserted into slot 46, cover member 16 will be in the correct transverse position relative to gutter 12, and may then be attached to the roof. Installation of the gutter cover system is greatly facilitated by use of preinstalled brackets in this manner. A deep channel 48 is provided so that the bracket will not cause water flowing off of water directing portion 22 to splash away from gutter 12. In one exemplary embodiment, the width W of bracket 40 may be about one inch.

Figure 9:
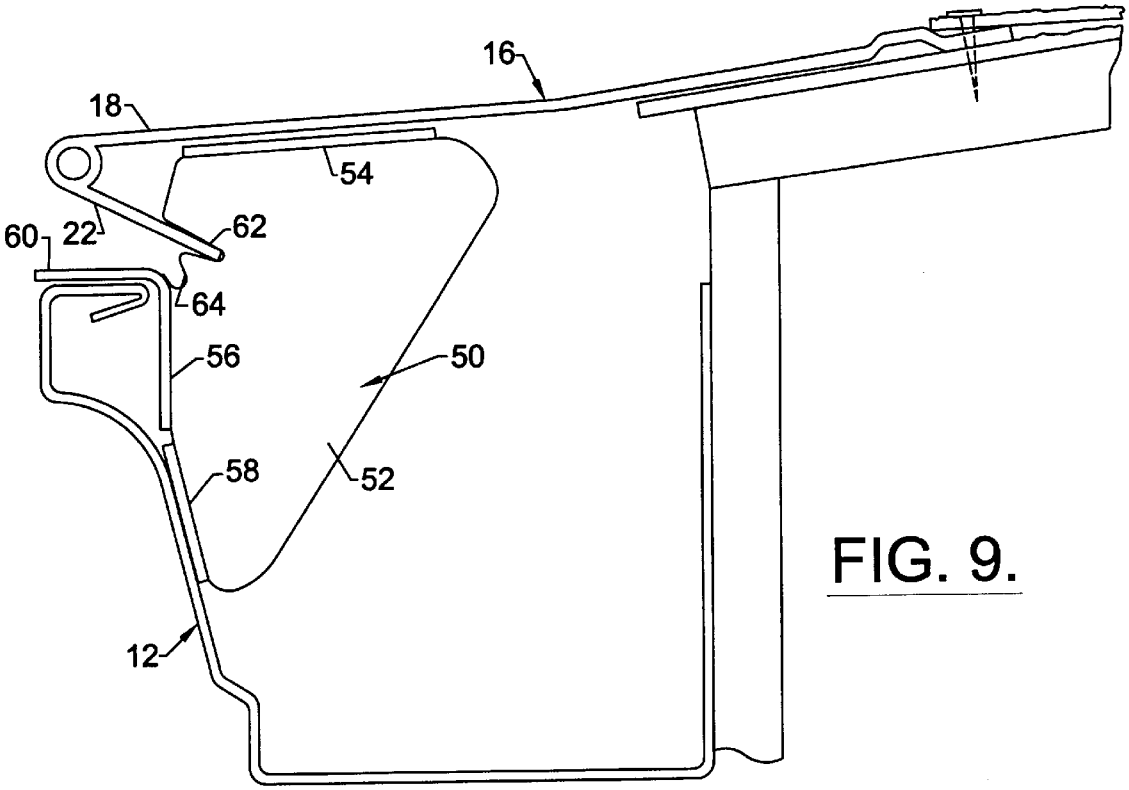
FIG. 9 is a view similar to FIG. 2 illustrating a second bracket configuration.
Figure 10:
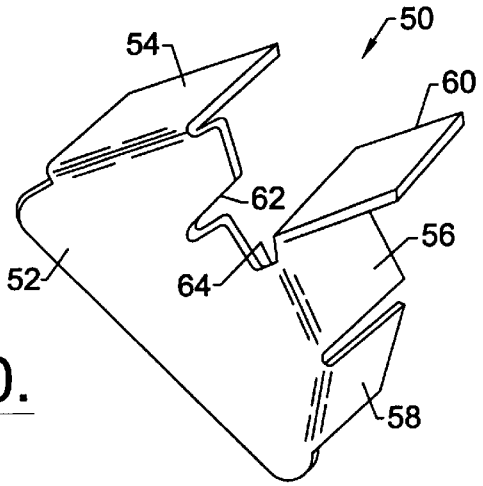
FIG. 10 is a perspective view of the bracket utilized in FIG. 9.

An alternative bracket 50 is illustrated in FIGS. 9 through 10. Bracket 50 is formed of a flat material, such as sheet metal or molded plastic, configured to provide a desired bracket width. Toward this end, bracket 50 includes a web portion 52 having a plurality of width portions 54, 56 and 58 extending perpendicularly thereto. A shelf portion 60 extends perpendicularly from width portion 56 to rest on the upper surface of gutter 12. Like bracket 40, a slot 62 is defined in bracket 50 for receipt of water directing portion 22. A channel 64 is provided to facilitate flow of water into the gutter without splashing away from the gutter.

Figure 11:
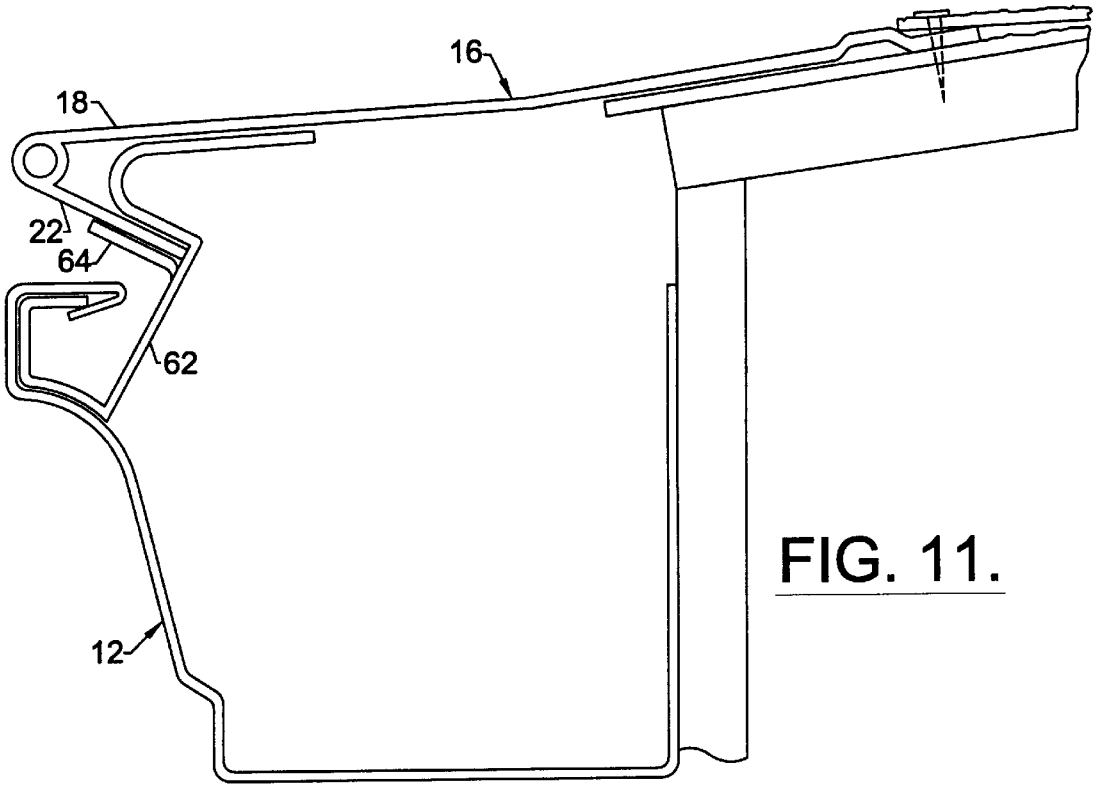
FIG. 11 is a view similar to FIG. 2 illustrating a third bracket configuration.

FIG. 11 illustrates a further bracket 62 which may also be formed of sheet metal, molded plastic or other flat material. Width portions like those of bracket 50 are not required in this case, since the entire width of the bracket is already facing gutter 12 and cover member 16. A tongue 64 extends from the main portion of bracket 62 to form a slot into which water directing portion is received. When bracket 62 is formed of sheet metal, tongue 64 may be simply punched out of the main piece at the time of manufacture.

Figure 12:
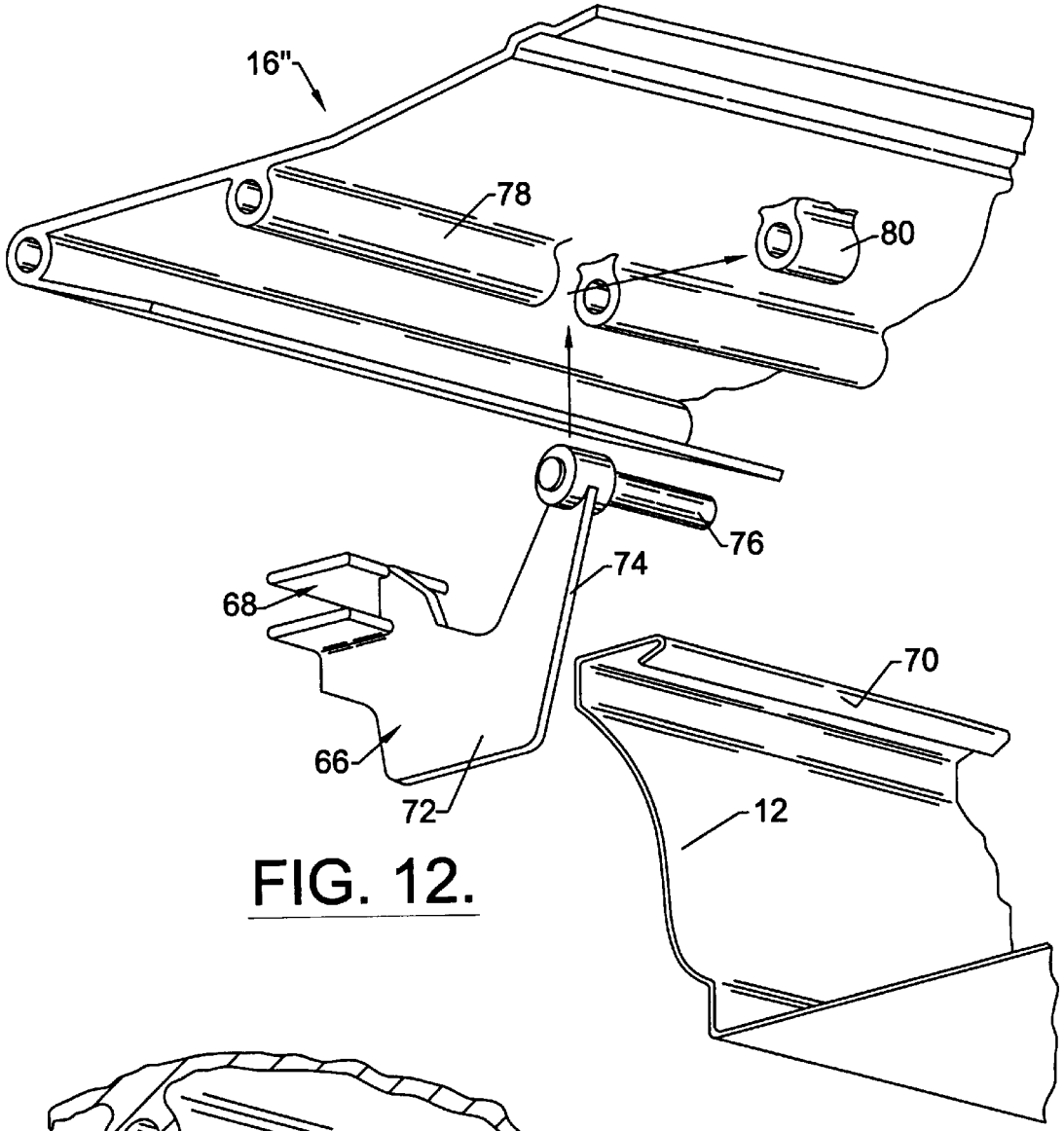
FIG. 12 is a bottom perspective view illustrating a fourth bracket configuration utilized with a gutter cover modified having a longitudinal mounting tube fixed thereto.

FIG. 12 illustrates a further embodiment that may be advantageous in certain applications. In this case, a bracket 66 is provided defining a frontal slot 68 for receipt of the lip 70 of gutter 12. Bracket 66 includes a web portion 72 having an arm element 74 integrally extending therefrom. As shown, a relatively blunt-nosed pin member 76 extends laterally from arm element 74.

In this case, a modified cover member 16" is provided having a longitudinal mounting tube 78 attached to a bottom thereof. Preferably, mounting tube 78 may be integrally formed with cover member 16", such as by coextrusion. As shown, a segment 80 of mounting tube 78 may be removed at the time of installation. This permits pin member 76 to be inserted therein, thereby maintaining cover member 16" in position.

Figure 13A:
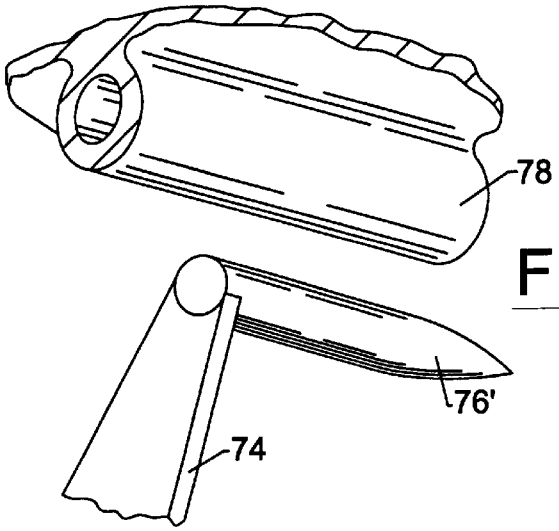
FIGS. 13A through 13C illustrate use of a modified for of a bracket configuration otherwise as shown in FIG. 12.
Figure 13B:
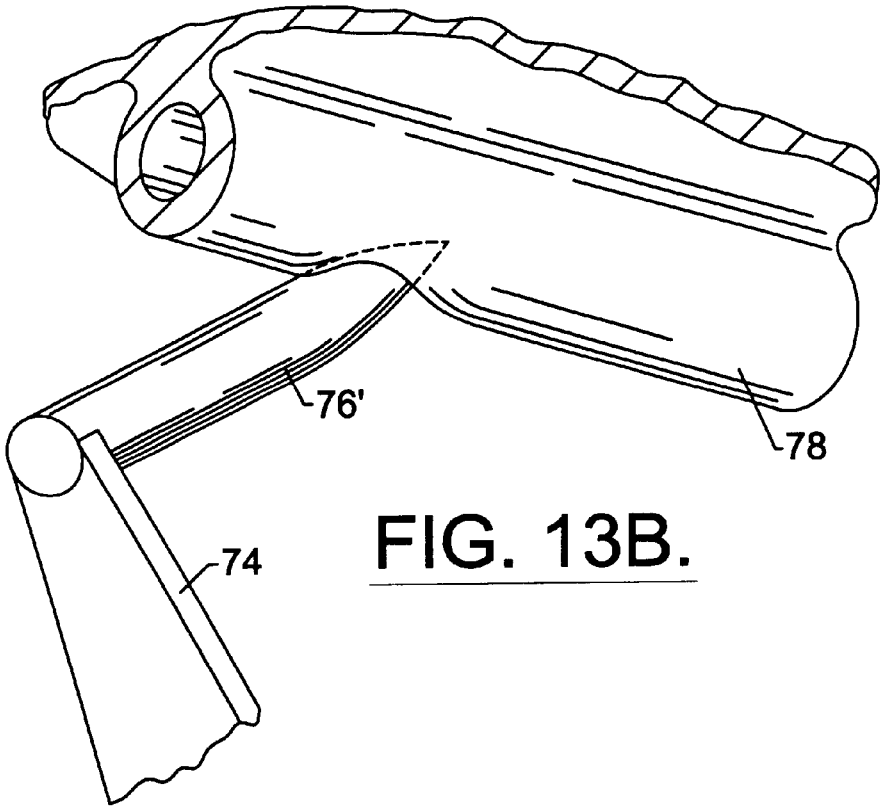
Figure 13C:
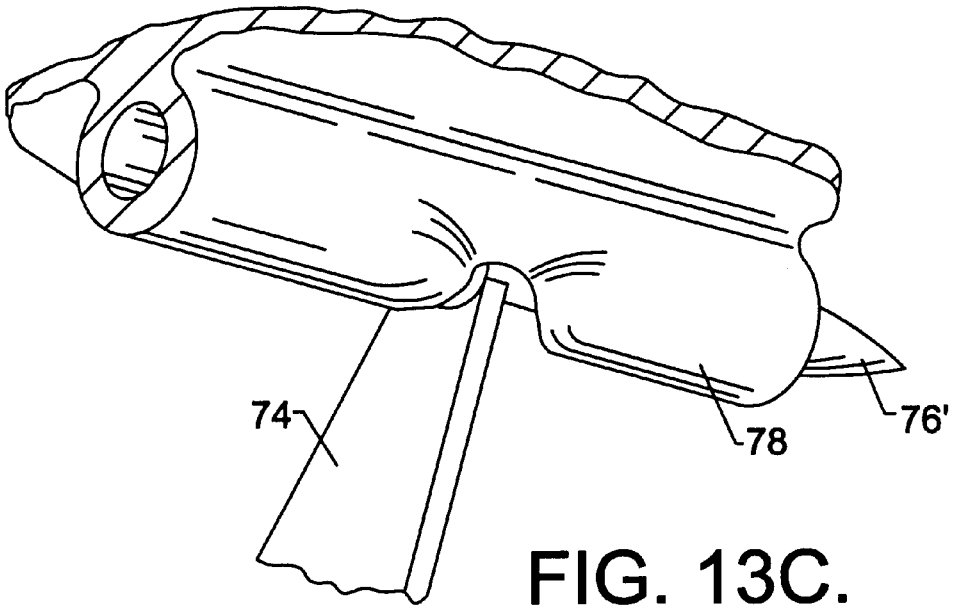

FIGS. 13A through 13C illustrate a modification to bracket 66. In this case, a pin member 76' is provided having a relatively sharp tip. This sharp tip permits direct insertion into mounting tube 78, without removing a segment 80 as described above. In either case, mounting tube 78 is preferably formed of a soft material, both to facilitate the installation process and to desirably flatten when cover member 16" is coiled. Advantageously, the presence of mounting tube 78 may tend to provide a more stable reel without utilizing a disposable cord or tape as mentioned above.

It can be seen that various novel gutter cover arrangements have been provided to satisfy various objects of the invention. While preferred embodiments of the invention have been shown and described, modifications and variations may be made thereto by those of ordinary skill in the art without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to be limitative of the invention so further described in such appended claims.

What is claimed is:

1. A rain gutter cover comprising:

an elongate cover member adapted to be situated over an open trough of a rain gutter and being substantially entirely formed of a flexible plastic material, said cover member having a first cover portion integrally extending into a second water directing portion about a rounded nose portion, a bottom surface of said first cover portion being angularly separated from an inner surface of said second water directing portion about angle of less than 90°;

an outer surface of said elongate cover member being nonperforated so that water will flow thereacross, said outer surface being adapted to substantially cause such water to film; and said cover member being coiled in a long dimension thereof while said second water directing portion is folded back on said first cover portion in a first compact supply configuration, said second water directing portion being formable into a second operative configuration upon said cover member being uncoiled.

2. A rain gutter cover as set forth in claim 1, wherein said plastic material comprises a PVC material.

3. A rain gutter cover as set forth in claim 2, wherein an outer surface of said cover member has been adapted to facilitate filming of said water.

4. A rain gutter cover as set forth in claim 1, wherein said elongate cover member is formed of at least two plastic materials having different elasticity properties to facilitate formation of said cover member into said supply and operative configurations.

5. A rain gutter cover as set forth in claim 1, wherein said first cover portion and said second water directing portion are each substantially planar.

6. A rain gutter cover as set forth in claim 5, wherein said rounded nose portion is rendered flexible by a plurality of parallel score lines defined thereon to facilitate formation of said cover member into said supply and operative configurations.

7. A rain gutter cover as set forth in claim 1, further comprising at least one bracket device configured for attachment between said cover member and said rain gutter to maintain said cover member in position thereover.

8. A rain gutter cover as set forth in claim 7, wherein said bracket comprises configured flat material.

9. A rain gutter cover as set forth in claim 7, wherein said bracket comprises a configured block of material.

10. A rain gutter cover as set forth in claim 7, further comprising a mounting tube attached to a bottom surface of said first cover portion, said bracket comprising a pin member for insertion into said mounting tube.

11. A rain gutter cover comprising:

an elongate cover member adapted to be situated over an open trough of a rain gutter, said cover member having a substantially planar first cover portion integrally extending into a substantially planar second water directing portion about a rounded nose portion;

an outer surface of said elongate cover member being adapted to substantially cause water passing thereover to film;

said cover member being formable into a first compact supply configuration and a second operative configuration; and a web member interconnecting inner surfaces of said first cover portion and said second water directing portion to maintain a predetermined angular separation, therebetween when said cover member is in said operative configuration, said web member being sufficiently flexible so as to permit said cover member to achieve said supply configuration.

12. A rain gutter cover for use with a rain gutter which collects water flowing from a roof of a structure, said rain gutter cover comprising:

an elongate cover member adapted to be situated over an open trough of said rain gutter, said elongate cover member formed substantially entirely of flexible plastic material formable into a first supply configuration for coiling in a long dimension thereof and a second operative configuration upon being uncoiled;

said elongate cover member having a first cover portion adapted to be connected to said roof of said structure, said first cover portion integrally extending into a second water directing portion about a rounded nose portion at a predetermined angular separation, said second water directing portion being terminated to above said open trough of said rain gutter when said cover member is mounted thereover; and at least one bracket device configured for attachment between said cover member and said rain gutter to maintain said cover member in position thereover, said bracket device maintaining said predetermined angular separation between said first cover portion and said second water directing portion of said cover member.

13. A rain gutter cover as set forth in claim 12, wherein an outer surface of said elongate cover member is adapted to substantially cause water to film while passing thereover.

14. A rain gutter cover as set forth in claim 13, wherein said plastic material comprises a PVC material.

15. A rain gutter cover as set forth in claim 14, wherein said elongate cover member is formed of at least two materials having different elasticity properties to facilitate formation of said cover member into said supply and operative configurations.

16. A rain gutter cover as set forth in claim 12, wherein said rounded nose portion is rendered flexible by a plurality of parallel score lines defined thereon to facilitate formation of said cover member into said supply and operative configuration.

17. A rain gutter cover as set forth in claim 12, wherein said bracket comprises configured flat material.

18. A rain gutter cover as set forth in claim 12, wherein said bracket comprises a configured block of material.

19. A rain gutter cover as set forth in claim 12, further comprising a mounting tube attached to a bottom surface of said first cover portion, said bracket comprising a pin member for insertion into said mounting tube.

20. A rain gutter cover for use with a rain gutter which collects water flowing from a roof of a structure, said rain gutter cover comprising:

an elongate cover member adapted to be situated over an open trough of said rain gutter, said elongate cover member formed substantially entirely of flexible plastic material formable into a first supply configuration for coiling in a long dimension thereof and a second operative configuration upon being uncoiled;

said elongate cover member having a first cover portion adapted to be connected to said roof of said structure, said first cover portion integrally extending into a second water directing portion about a rounded nose portion, said second water directing portion being terminated to above said open trough of said rain gutter when said cover member is mounted thereover;

at least one bracket device configured for attachment between said cover member and said rain gutter to maintain said cover member in position thereover; and a web member interconnecting inner surfaces of said first cover portion and said second water directing portion to maintain a predetermined angular separation therebetween when said cover member is in said operative configuration, said web member being sufficiently flexible so as to permit said cover member to achieve said supply configuration.

21. A rain gutter cover for use with a rain gutter which collects water flowing from a roof of a structure, said rain gutter cover comprising:

an elongate cover member adapted to be situated over an open trough of said rain gutter, said cover member having a substantially planar first cover portion adapted to be connected to said roof of said structure, said first cover portion integrally extending about a rounded nose portion into a substantially planar second water directing portion, said second water directing portion being terminated to above said open trough of said rain gutter when said cover member is mounted thereover; and said cover member further comprising a web member interconnecting inner surfaces of said first cover portion and said second water directing portion to maintain a predetermined angular separation therebetween.

22. A rain gutter cover as set forth in claim 21, wherein said cover member is formed substantially entirely of flexible plastic material formable into a first supply configuration for coiling in a long dimension thereof and a second operative configuration upon being uncoiled.

23. A rain gutter cover as set forth in claim 21, wherein an outer surface of said elongate cover member is adapted to substantially cause water to film while passing thereover.

24. A rain gutter cover as set forth in claim 21, wherein said elongate cover member is formed of at least two materials having different elasticity properties to facilitate formation of said cover member into said supply and operative configurations.

25. A rain gutter cover as set forth in claim 21, further comprising at least one bracket device configured for attachment between said cover member and said rain gutter to maintain said cover member in position thereover.

26. A method of producing a rain gutter cover for use with a rain gutter which collects water flowing from a roof of a structure, said method comprising steps of:

(a) providing a coil of an elongate cover member in a first supply configuration, said elongate cover member being substantially formed of a flexible plastic material having a first cover portion adapted to be connected to said roof of said structure, said first cover portion integrally extending into a second water directing portion about a rounded nose portion at a predetermined angular separation, said second water directing portion, being folded back on said first cover portion in said first supply configuration;

(b) withdrawing a predetermined length of said elongate cover member from said coil; and (c) mounting said predetermined length of said elongate cover member over an open trough of said rain gutter in a second operative configuration, wherein said second water directing portion is formable and is terminated to said open trough of said rain gutter.

27. A method as set forth in claim 26, wherein said elongate cover member is maintained in position with respect to said rain gutter utilizing at least one bracket device.

* * * * *